US005470400A

United States Patent [19]

Bogatin et al.

[11] Patent Number: 5,470,400

[45] Date of Patent: Nov. 28, 1995

[54] RARE EARTH ANISOTROPIC MAGNETIC MATERIALS FOR POLYMER BONDED MAGNETS

[75] Inventors: Yakov Bogatin, Richboro; Mark Robinson, West Lawn, both of Pa.; Frank S. Greenwald, Woodstock; John Ormerod, Rockford, both of Ill.

[73] Assignee: SPS Technologies, Inc., Jenkintown, Pa.

[21] Appl. No.: 251,455

[22] Filed: May 31, 1994

Related U.S. Application Data

[60] Division of Ser. No. 826,558, Jan. 27, 1992, which is a continuation-in-part of Ser. No. 535,460, Jun. 8, 1990, Pat. No. 5,122,203, which is a continuation-in-part of Ser. No. 365,622, Jun. 13, 1989, Pat. No. 5,114,502.

[51] Int. Cl.[6] ..... H01F 1/055

[52] U.S. Cl. ..... 148/301; 252/62.54

[58] Field of Search ..... 148/301; 252/62.54

[56] References Cited

FOREIGN PATENT DOCUMENTS 55-11339 1/1980 Japan .
64-69001 3/1989 Japan .

OTHER PUBLICATIONS

Translation of Japanese Kokai 63-247504, Dec. 5, 1988.

*Primary Examiner*—John Sheehan
*Attorney, Agent, or Firm*—James D. Dee

[57] ABSTRACT

This invention relates to a process for producing a non-pyrophoric, corrosion resistant rare earth-containing material capable of being formed into a polymer bonded permanent magnet comprising forming particles from a rare earth-containing alloy, and treating the alloy with a passivating gas comprised of nitrogen, carbon dioxide or a combination of nitrogen and carbon dioxide at a temperature below the phase transformation temperature of the alloy, and heat treating the alloy to produce material having a coercivity of at least 1,000 Oersteds. Rare earth-containing alloys suitable for use in producing magnets, such as Nd—Fe—B and Sm—Co alloys, can be used. If nitrogen is used as the passivating gas, the resultant powder particles have a nitrogen surface concentration of from about 0.4 to about 26.8 atomic percent. Moreover, if carbon dioxide is used as the passivating gas, the resultant powder particles have a carbon surface concentration of from about 0.02 to about 15 atomic percent. The particles made in accordance with the present invention are capable of being aligned by a magnetic field to produce an anisotropic polymer bonded permanent magnet.

5 Claims, 15 Drawing Sheets

RARE EARTH ANISOTROPIC MAGNETIC MATERIALS FOR POLYMER BONDED MAGNETS

This is a divisional of co-pending application Ser. No. 07/826,558 filed on Jan. 27, 1992, which is a continuation-in-part of application Ser. No. 07/535,460, filed Jun. 8, 1990, now U.S. Pat. No. 5,122,203, which is a continuation-in-part of application Ser. No. 07/365,622, filed Jun. 13, 1989, now U.S. Pat. No. 5,114,502.

BACKGROUND OF THE INVENTION

1. Field of the Invention

This invention generally relates to magnetic materials and, more particularly, to rare earth-containing anisotropic magnetic materials for polymer bonded magnets, and processes for producing the same.

2. Description of the Prior Art

Permanent magnet materials currently in use include alnico, hard ferrite and rare earth/cobalt magnets. Recently, new magnetic materials have been introduced containing iron, various rare earth elements and boron. Such magnets have been prepared from melt quenched ribbons and also by the powder metallurgy technique of compacting and sintering, which was previously employed to produce samarium cobalt magnets.

Suggestions of the prior art for rare earth permanent magnets and processes for producing the same include: U.S. Pat. No. 4,597,938, Matsuura et al., which discloses a process for producing permanent magnet materials of the Fe—B— R type by: preparing a metallic powder having a mean particle size of 0.3–80 microns and a composition consisting essentially of, in atomic percent, 8–30% R representing at/least one of the rare earth elements inclusive of Y, 2 to 28% B and the balance Fe; compacting; and sintering the resultant body at a temperature of 900°–1200° C. in a reducing or non-oxidizing atmosphere. Co up to 50 atomic percent may be present. Additional elements M (Ti, Ni, Bi, V, Nb, Ta, Cr, Mo, W, Mn, Al, Sb, Ge, Sn, Zr, Hf) may be present. The process is applicable for anisotropic and isotropic magnet materials. Additionally, U.S. Pat. No. 4,684,406, Matsuura et al., discloses a certain sintered permanent magnet material of the Fe—B— R type, which is prepared by the aforesaid process.

Also, U.S. Pat. No. 4,601,875, Yamamoto et al., teaches permanent magnet materials of the Fe—B— R type produced by: preparing a metallic powder having a mean particle size of 0.3–80 microns and a composition of, in atomic percent, 8–30% R representing at least one of the rare earth elements inclusive of Y, 2–28% B and the balance Fe; compacting; sintering at a temperature of 900°–120° C.; and, thereafter, subjecting the sintered bodies to heat treatment at a temperature lying between the sintering temperature and 350° C. Co and additional elements M (Ti, Ni, Bi, V, Nb, Ta, Cr, Mo, W, Mn, Al, Sb, Ge, Sn, Zr, Hf) may be present. Furthermore, U.S. Pat. No. 4,802,931, Croat, formula $RE_{1-x}(TM_{1-y}B_y)_x$. In this formula, RE represents one or discloses an alloy with hard magnetic properties having the basic more rare earth elements including scandium and yttrium in Group IIIA of the periodic table and the elements from atomic number 57(lanthanum) through 71(lutetium). TM in this formula represents a transition metal taken from the group consisting of iron or iron mixed with cobalt, or iron and small amounts of other metals such as nickel, chromium or manganese.

However, prior art attempts to manufacture permanent magnets utilizing powder metallurgy technology have suffered from substantial shortcomings. For example, crushing is typically carried out in a crushing apparatus using an organic liquid or a gas environment. This liquid may be, for example, hexane, petroleum ether, glycerin, methanol, toluene, or other suitable liquid. A special liquid environment is utilized since the powder produced during crushing is rare earth metal based and, accordingly, the powder is chemically active, pyrophoric and readily oxidizable. However, the aforementioned liquids are relatively costly and pose a potential health hazard due to their toxicity and flammability. Furthermore, crushing an alloy mass to make suitable powder in the aforementioned environment is also disadvantageous since the powder produced has a high density of certain defects in the crystal structure which adversely affect the magnetic properties. Additionally, crushing in the organic liquid environment unduly complicates the attainment of the desired shape, size, structure, magnetic field orientation and magnetic properties of the powders and resultant magnets since the organic liquid environments have a relatively high viscosity which interferes with achieving the desired results. Moreover, attempts to passivate the surfaces of the powder particles by coating them with a protective substance, such as a resin, nickel or the like, during and after crushing is a generally ineffective and complicated process which increases the cost of manufacturing.

Furthermore, rare earth containing alloys are used to produce polymer bonded magnets where lower cost and good magnetic properties are repaired. Generally, the bonded permanent magnets are made of a dispersion of appropriate alloy particles in a bonding non-magnetic matrix, such as an epoxy. The permanent magnet particles are dispersed in the polymer bonding matrix and the matrix is allowed to cure either with or without magnetically aligning the dispersed particles therein.

Polymer bonded magnets are prepared from melt-spun alloy ribbons by breaking the friable ribbon into small pieces and then compacting the pieces under high pressure into the desired magnet shapes, as taught in U.S. Pat. No. 4,902,361, Lee et al. The voids of the compact are typically filled with the polymer, such as epoxy, to form isotropic bonded magnets. Alloy material produced by the conventional powder metallurgy technique of compacting and sintering can also be used to produce polymer bonded magnets by crushing or comminuting these alloys to produce the fine particles required in the process. However, the crushing of the alloy to produce the fine particles renders the particles pyrophoric and results in a significant decrease in the intrinsic coercivity of the alloy to a level wherein the particles are not suitable for use in producing bonded magnets. Additionally, any bonded magnets made from the particles would be magnetically unstable. Accordingly, there remains a need in the art for a process for producing a non-pyrophoric, corrosion resistant, magnetically anisotropic rare earth containing material capable of being formed into a polymer bonded permanent magnet.

SUMMARY OF THE INVENTION

This invention relates to a process for producing a non-pyrophoric, corrosion resistant rare earth-containing material capable of being formed into a polymer bonded permanent magnet comprising forming particles from a rare earth-containing alloy and treating the alloy with a passivating gas comprised of nitrogen, carbon dioxide or a combination of nitrogen and carbon dioxide at a temperature below the phase transformation temperature of the alloy, and heat treating the alloy to produce material having a coercivity of at least 1,000 Oersteds.

The alloy can comprise, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron. Other rare earth-containing alloys suitable for use in producing permanent magnets utilizing the powder metallurgy technique, such as samarium cobalt alloys, can also be used.

The alloys are processed to attain a particle size of from about 0.05 microns to about 100 microns and, preferably, a particle size of from 1 micron to 40 microns. The passivating gas can be nitrogen, carbon dioxide or a combination of nitrogen and carbon dioxide. If nitrogen is used as the passivating gas, the resultant particles have a nitrogen surface concentration of from about 0.4 to about 26.8 atomic percent. Moreover, if carbon dioxide is used as the passivating gas, the resultant particles have a carbon surface concentration of from about 0.02 to about 15 atomic percent. Additionally, the alloy is heat treated at a temperature from about 300° C. to about 1100° C. to product material having a coercivity of at least 1,000 Oersteds. The rare earth-containing powder produced in accordance with the present invention is anisotropic, non-pyrophoric and resistant to oxidation. Furthermore, the anisotropy displayed by the powders of this invention make them suitable for use in producing anisotropic magnets.

The present invention further relates to the production of a polymer bonded, corrosion resistant, permanent magnet comprising the steps for producing the rare earth-containing powder set forth above and then bonding the powder particles with a polymeric bonding agent.

The polymer bonded, corrosion resistant, anisotropic permanent magnet in accordance with the present invention includes the type of magnet comprising a polymeric bonding agent interspersed with single crystal or polycrystalline particles comprised of, in atomic percent of the overall composition, from 12% to 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and having a nitrogen surface concentration of from about 0.4 to about 26.8 atomic percent. The improved permanent magnet can also have a carbon surface concentration of from about 0.02 to about 15 atomic percent if carbon dioxide is used as a passivating gas. These polymer bonded permanent magnets have a high resistance to corrosion and a coercivity of at least 5,000 Oersteds.

Accordingly, it is an object of the present invention to provide processes for producing rare earth-containing powder which is resistant to oxidation and is non-pyrophoric. It is a further object of the present invention to provide rare earth-containing powder which has a coercivity of at least 1,000 Oersteds and is capable of being aligned by a magnetic field. It is also an object of the present invention to provide polymer bonded permanent magnets which are magnetically stable and have a high resistance to corrosion, as well as a coercivity of at least 5,000 Oersteds. These and other objects and advantages of the present invention will be apparent to those skilled in the art upon reference to the following description of the preferred embodiments.

DESCRIPTION OF THE PREFERRED EMBODIMENTS

Figure 1:
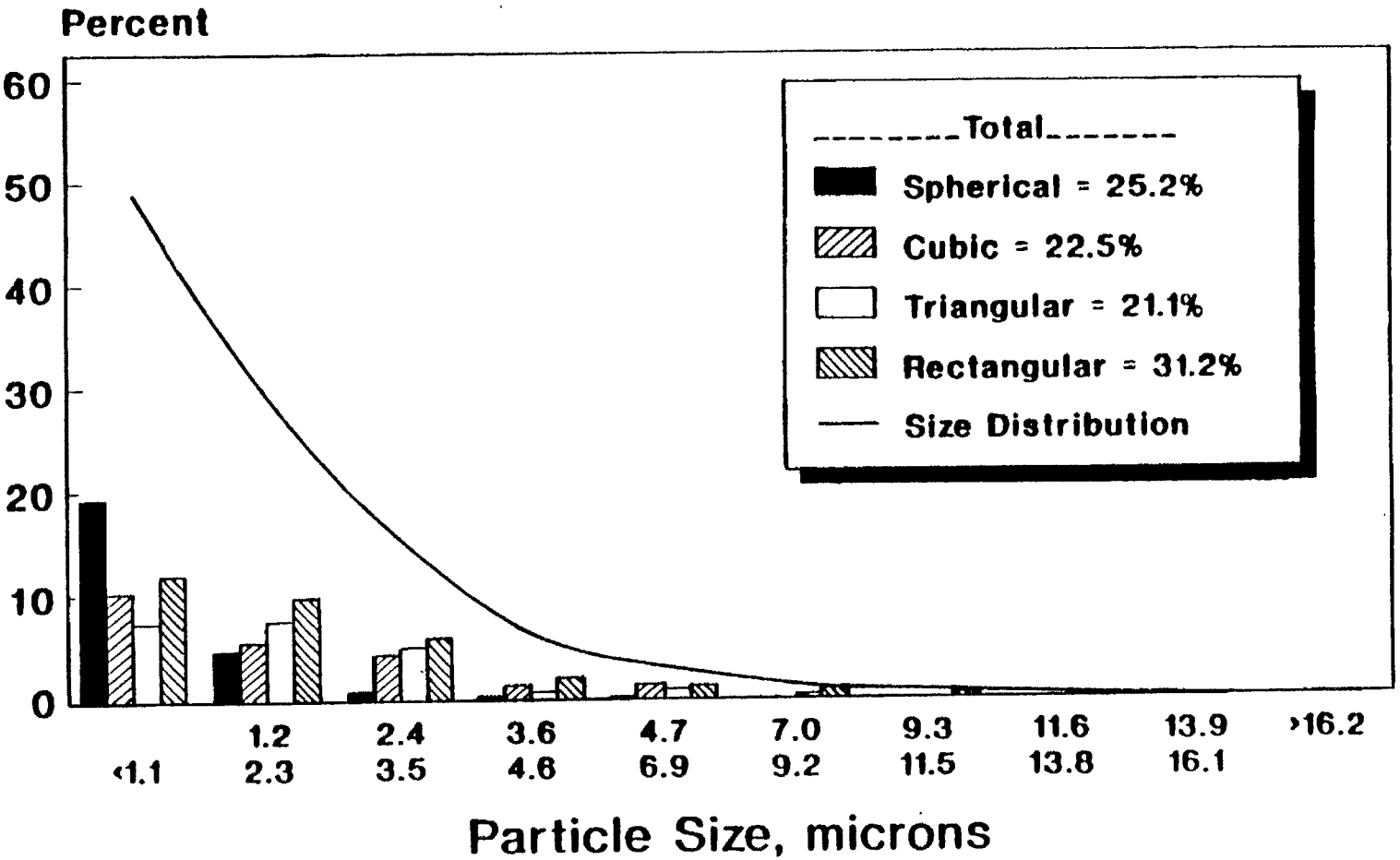
FIG. 1 is a graph showing the particle size and shape distribution for Nd—Fe—B powder produced in accordance with the present invention with $P_a/P_b$ of 1:16 and grinding time of 30 minutes.
Figure 2:
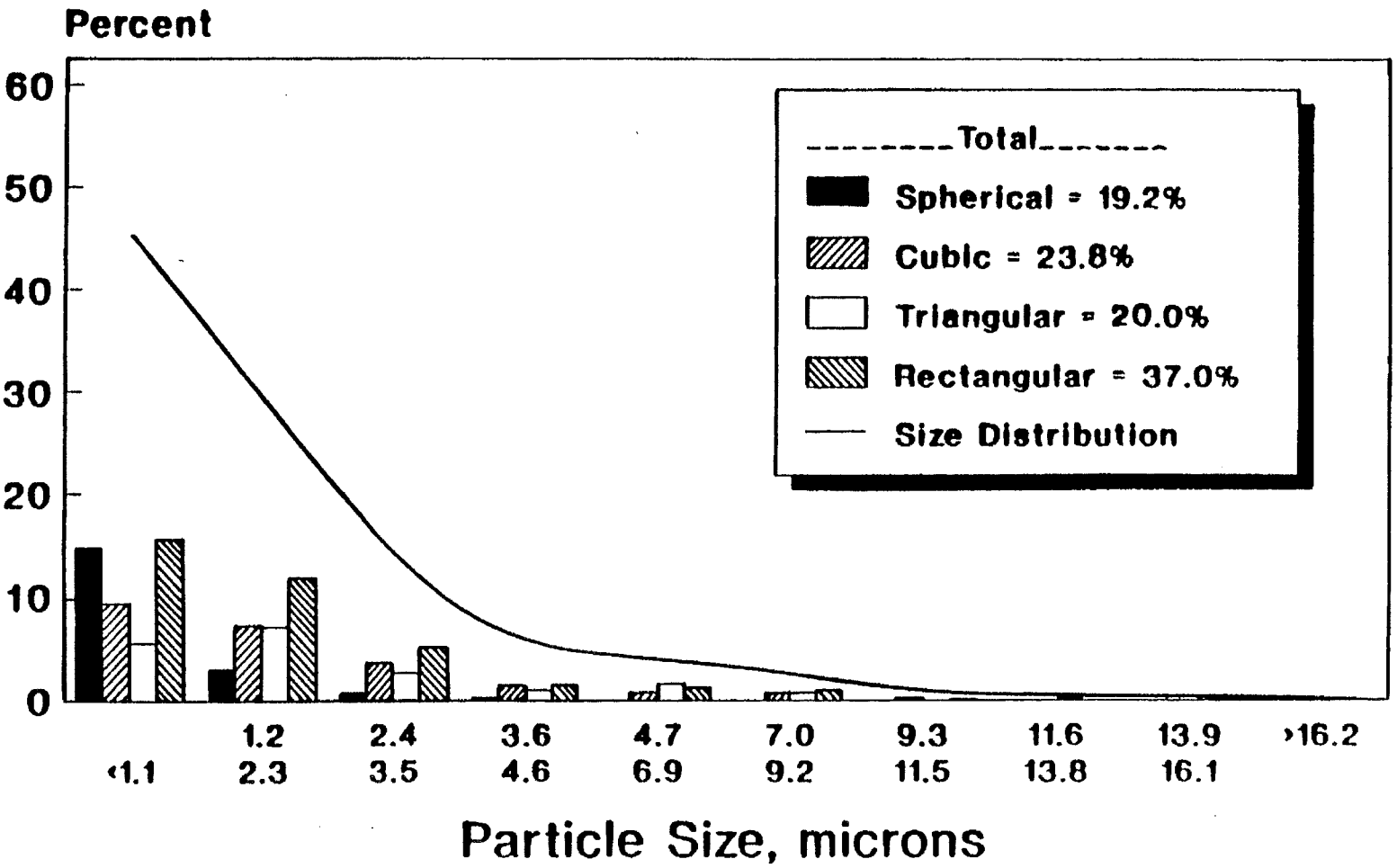
FIG. 2 is a graph showing the particle size and shape distribution for Nd—Fe—B powder produced in accordance with the present invention with $P_a/P_b$ of 1:16 and grinding time of 60 minutes.
Figure 3:
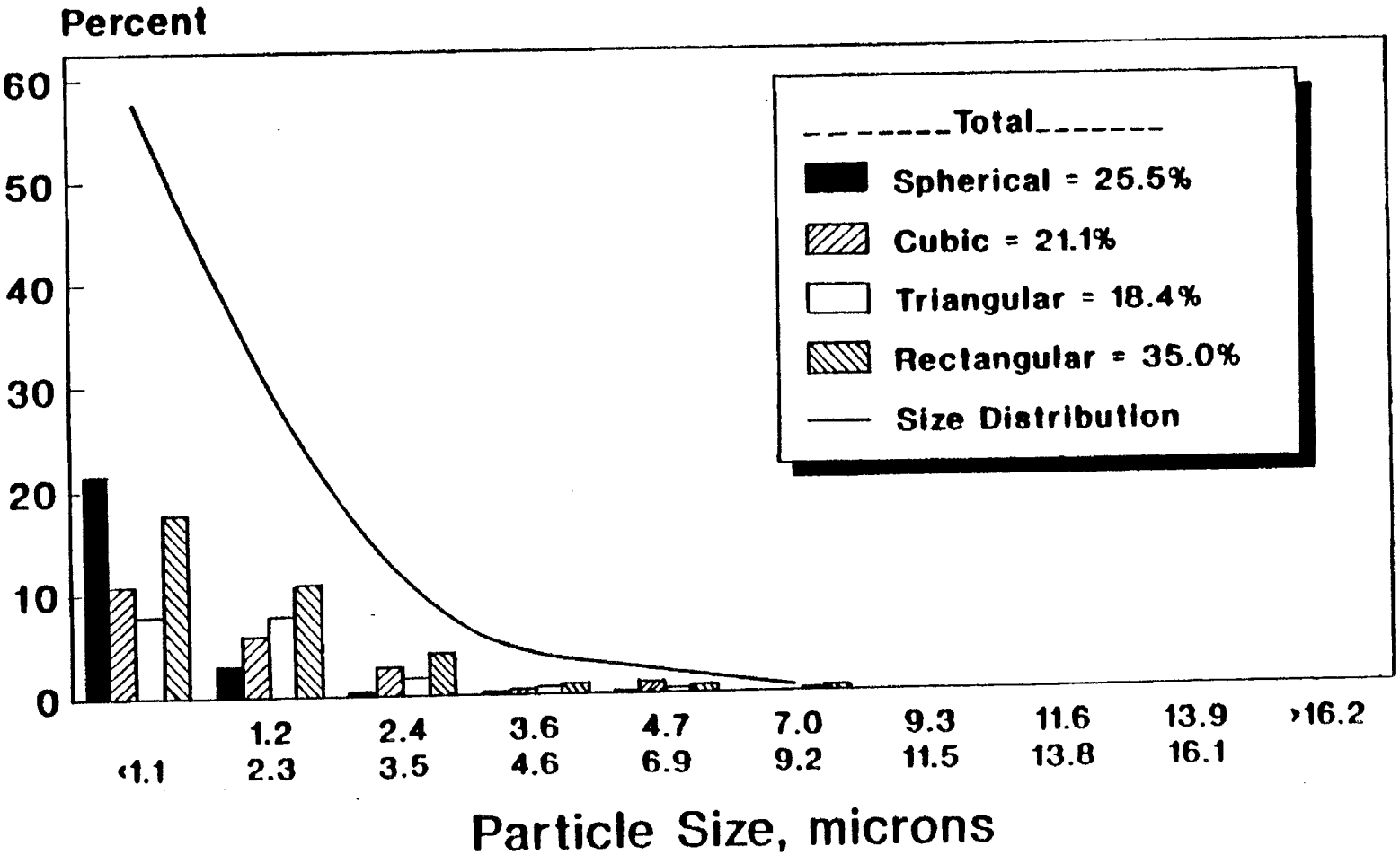
FIG. 3 is a graph showing the particle size and shape distribution for Nd—Fe—B powder produced in accordance with the present invention with $P_a/P_b$ of 1:16 and grinding time of 90 minutes.
Figure 4:
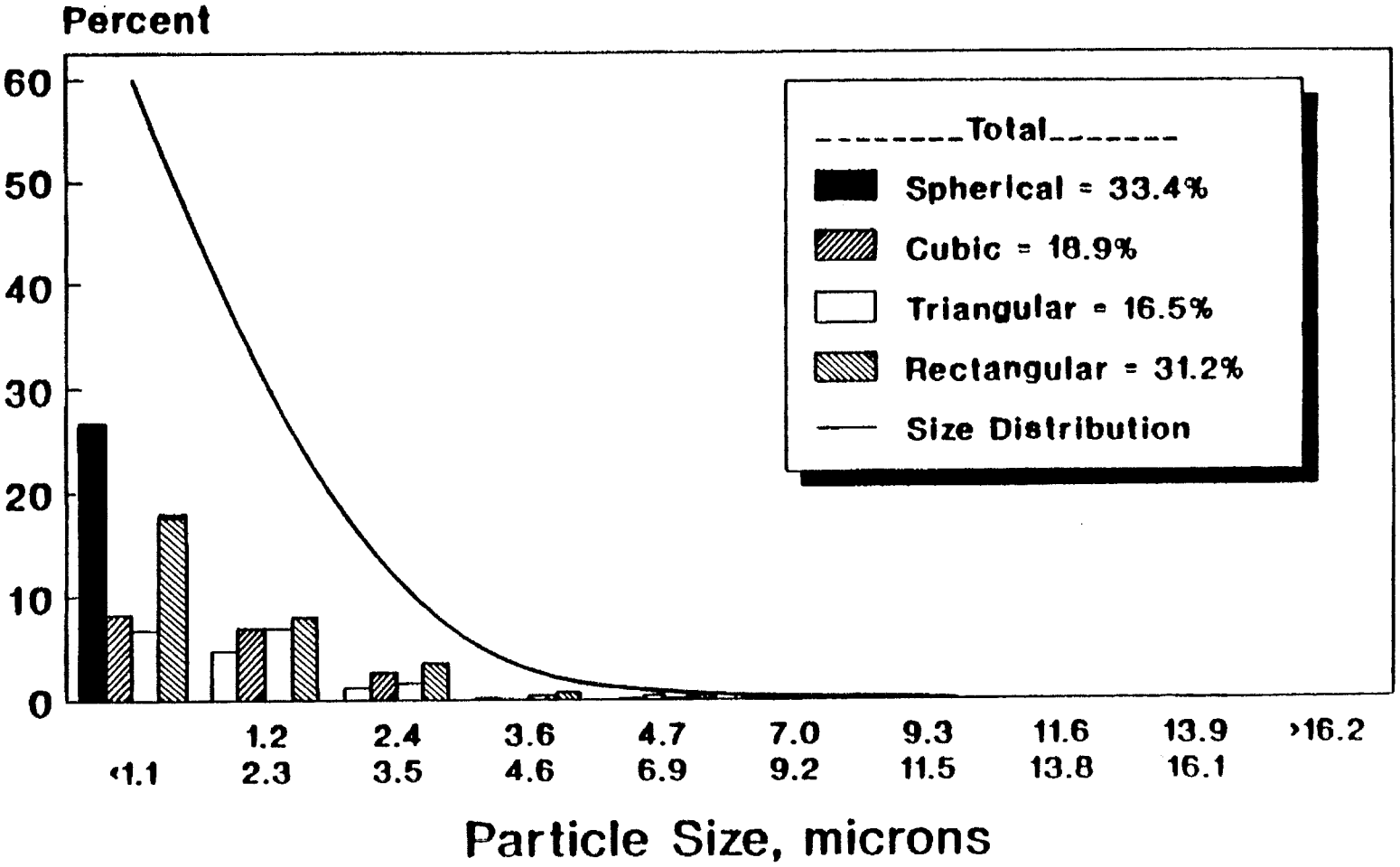
FIG. 4 is a graph showing the particle size and shape distribution for Nd—Fe—B powder produced in accordance with the present invention with $P_a/P_b$ of 1:16 and grinding time of 120 minutes.
Figure 5:
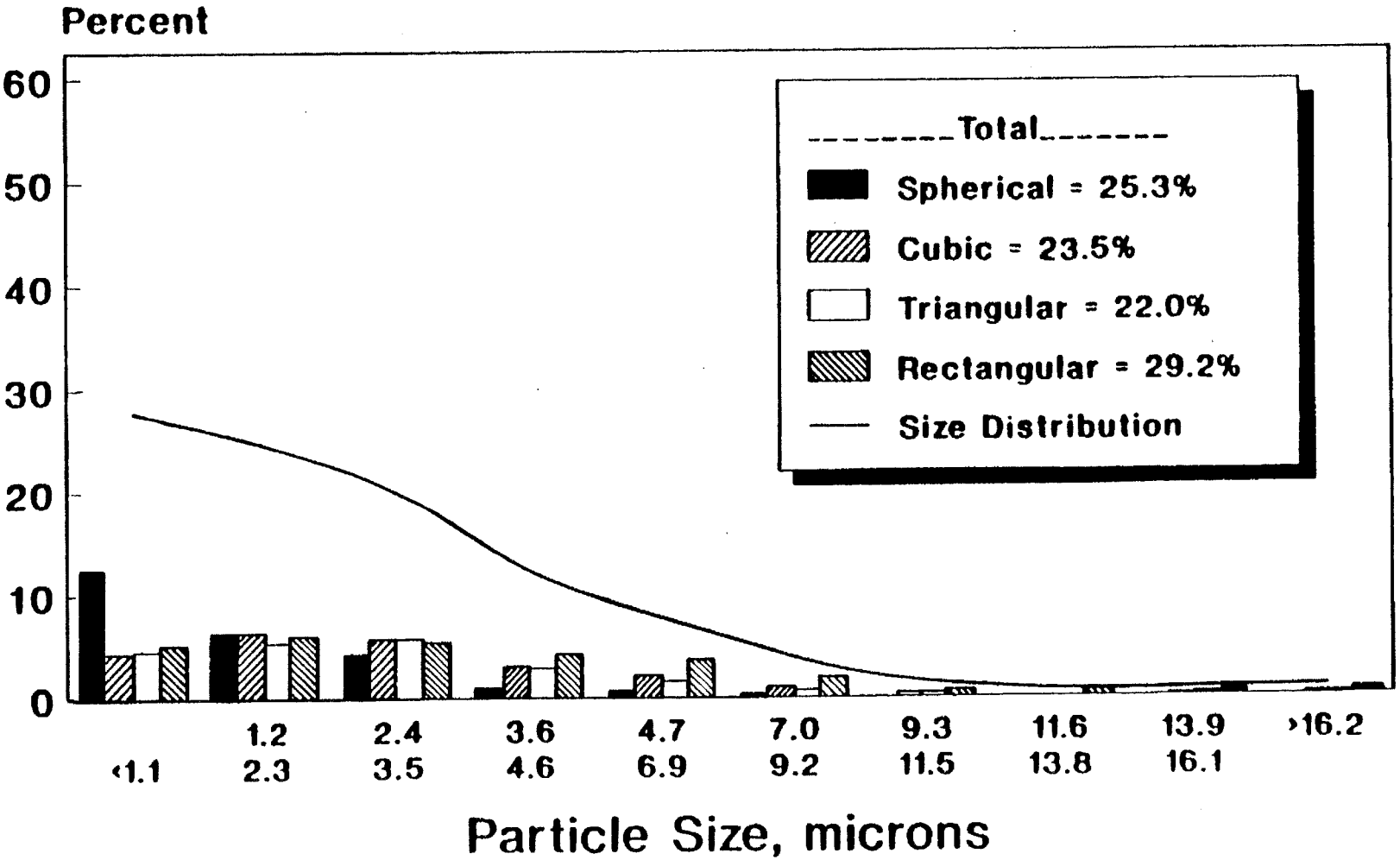
FIG. 5 is a graph showing the particle size and shape distribution for Nd—Fe—B powder produced in accordance with the present invention with $P_a/P_b$ of 1:24 and grinding time of 15 minutes.
Figure 6:
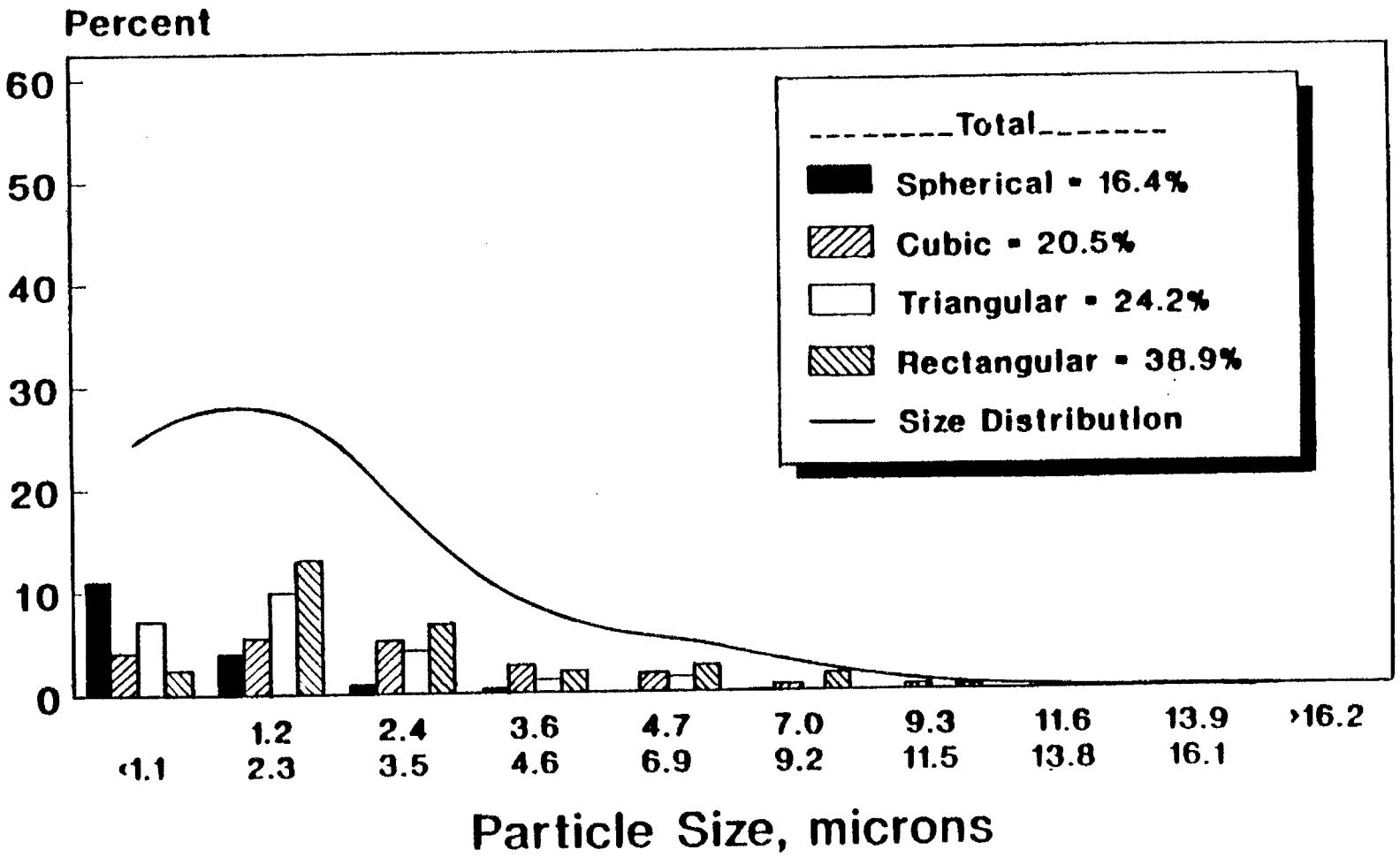
FIG. 6 is a graph showing the particle size and shape distribution for Nd—Fe—B powder produced in accordance with the present invention with $P_a/P_b$ of 1:24 and grinding time of 30 minutes.
Figure 7:
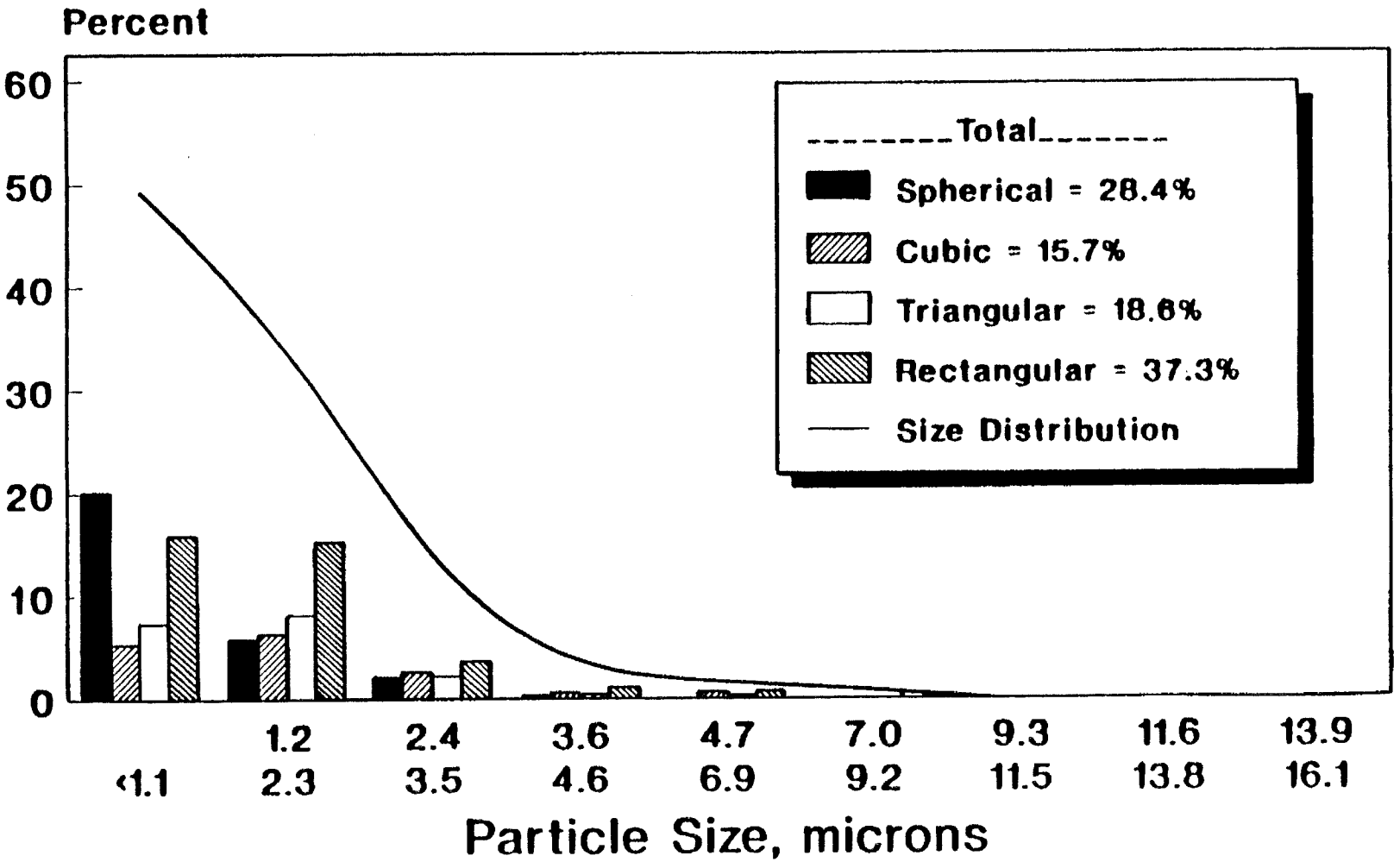
FIG. 7 is a graph showing the particle size and shape distribution for Nd—Fe—B powder produced in accordance with the present invention with $P_a/P_b$ of 1:24 and grinding time of 60 minutes.
Figure 8:
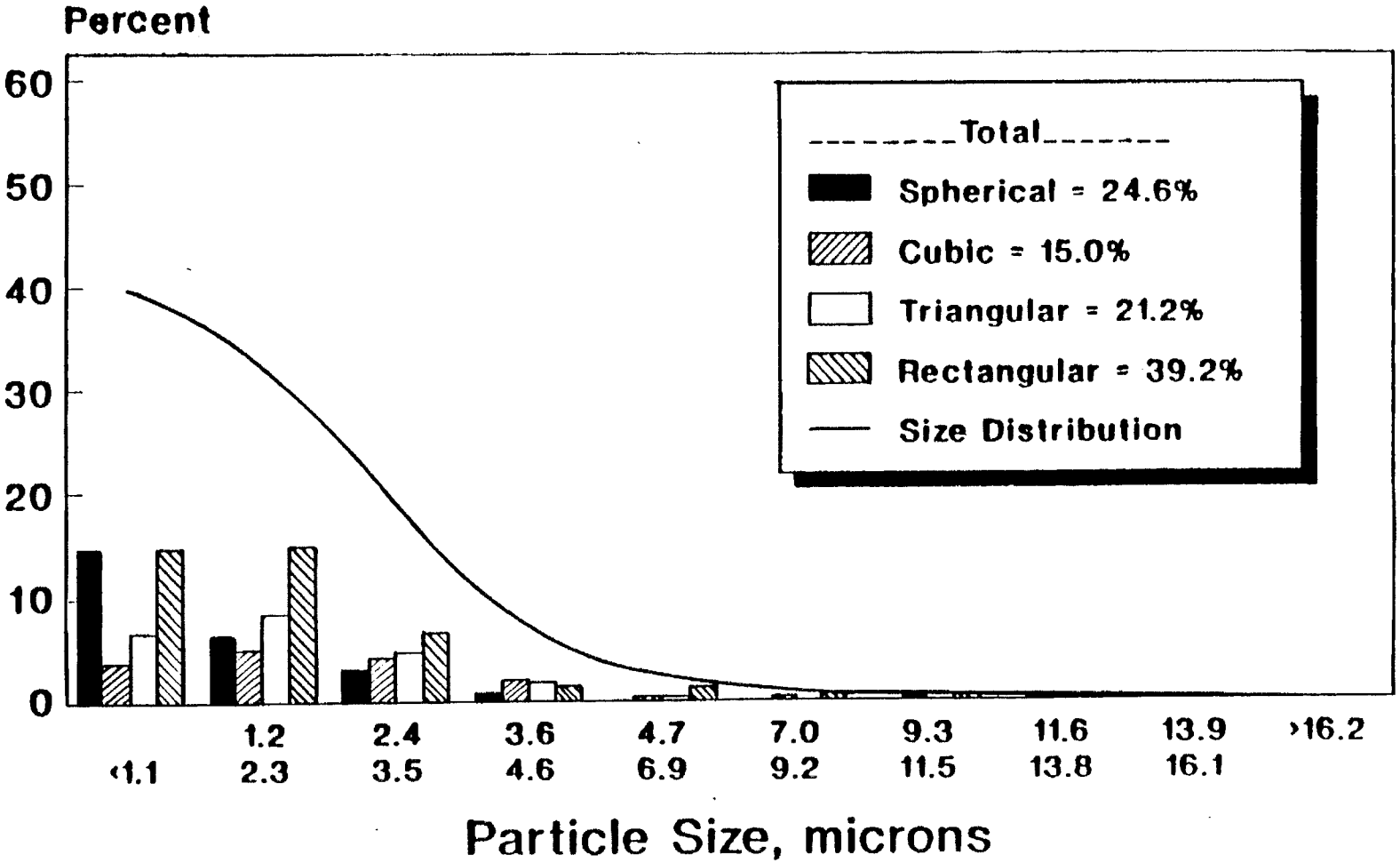
FIG. 8 is a graph showing the particle size and shape distribution for Nd—Fe—B powder produced in accordance with the present invention with $P_a/P_b$ of 1:24 and grinding time of 90 minutes.
Figure 9:
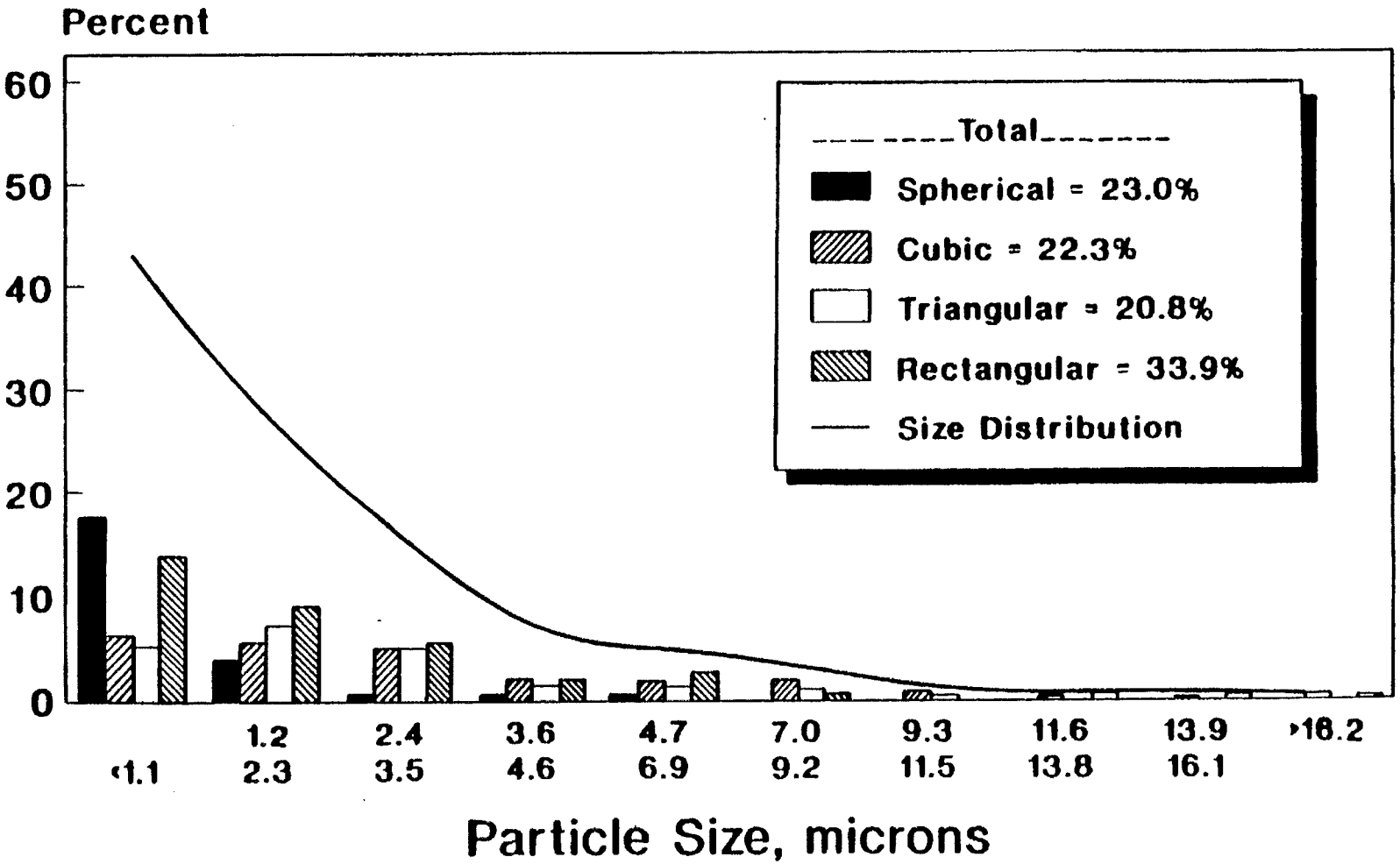
FIG. 9 is a graph showing the particle size and shape distribution for Nd—Fe—B powder produced in accordance with the present invention with $P_a/P_b$ of 1:32 and grinding time of 15 minutes.
Figure 10:
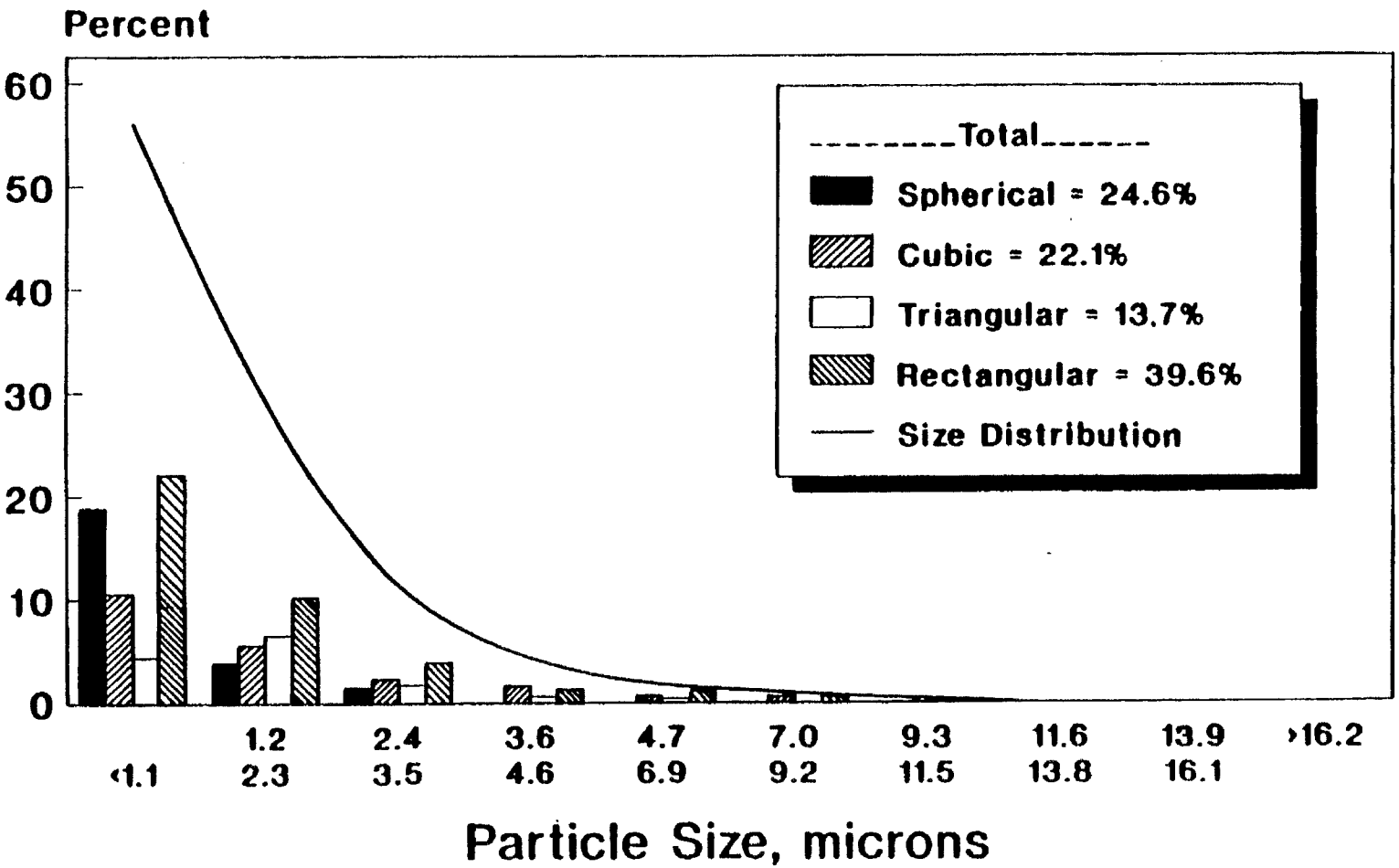
FIG. 10 is a graph showing the particle size and shape distribution for Nd—Fe—B powder produced in accordance with the present invention with $P_a/P_b$ of 1:32 and grinding time of 30 minutes.
Figure 11:
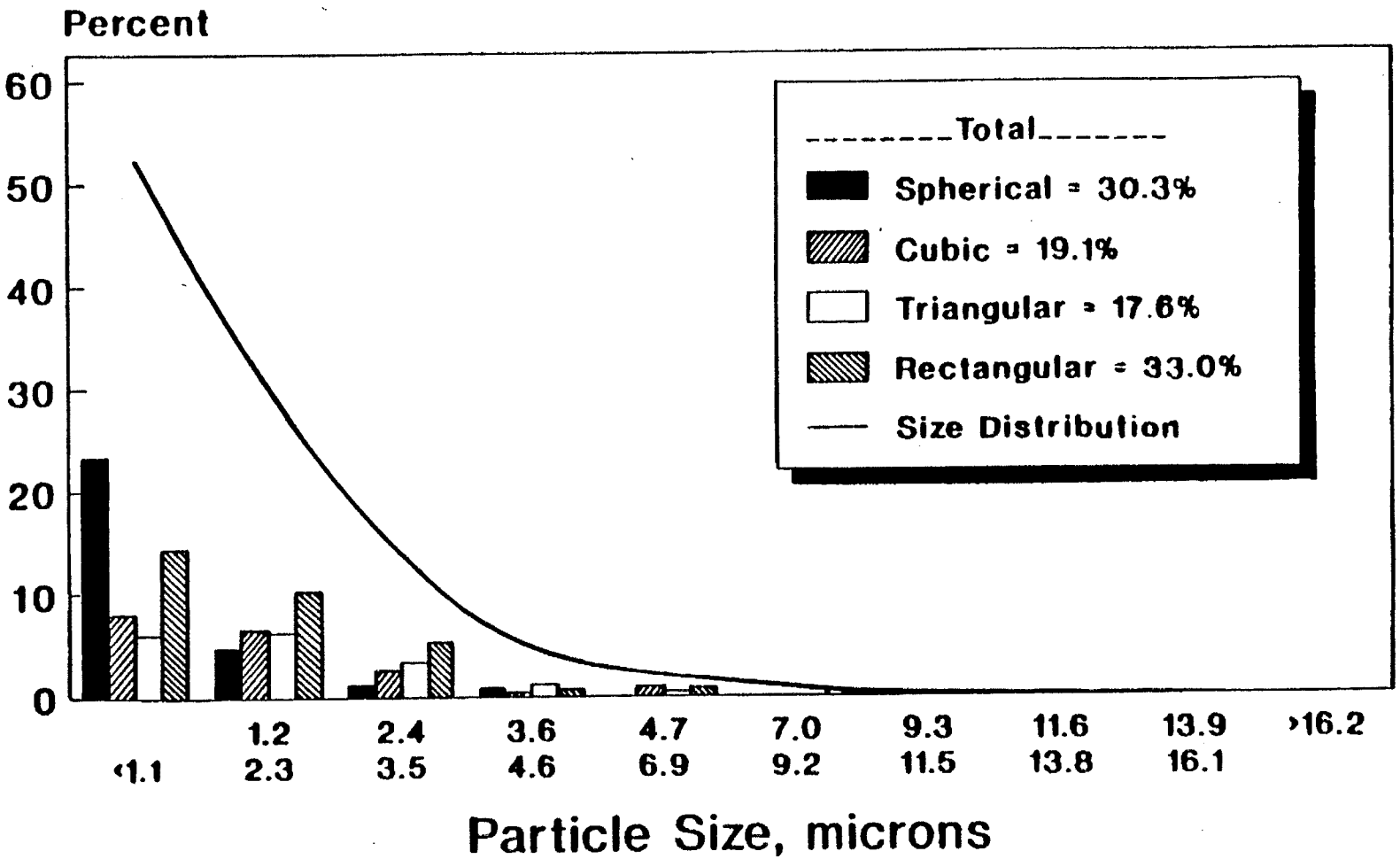
FIG. 11 is a graph showing the particle size and shape distribution for Nd—Fe—B powder produced in accordance with the present invention with $P_a/P_b$ of 1:32 and grinding time of 60 minutes.

The present invention relates to a process for producing a non-pyrophoric, corrosion resistant rare earth-containing powder capable of being formed into a polymer bonded permanent magnet comprising forming alloy particles from a rare earth-containing alloy, treating the alloy particles with a passivating gas comprised of nitrogen, carbon dioxide or a combination of nitrogen and carbon dioxide at a temperature below the phase transformation temperature of the material, and heat treating the alloy particles to produce material having a coercivity of at least 1,000 Oersteds. The present invention further relates to a process for producing an anisotropic polymer bonded permanent magnet comprising the above-mentioned processing steps to produce a powder and then performing the additional steps of aligning the powder in a magnetic field and binding the powder with a polymeric bonding agent. The magnetic materials produced in accordance with the present invention are corrosion resistant at ambient temperature and magnetically stable.

The first processing step of the instant invention involves the formation of particles having a particle size of from about 0.05 microns to about 100 microns from a rare earth-containing alloy. The rare earth-containing alloy can be prepared by any appropriate method known in the art. For example, the alloy can be jet milled to form particles having the appropriate size. The alloy can also be melt spun and then crushed to form particles having the appropriate size. Alternatively, the alloy can be prepared by placing an ingot or piece of a rare earth-containing alloy in a crushing apparatus and crushing the alloy. The crushing can occur in either water or a passivating gas. The term "crushing" as used herein is meant to include milling and comminuting processes known in the art. It is believed that any rare earth-containing alloy suitable for producing powders, compacts and permanent magnets by the conventional powder metallurgy method can be utilized. For example, the alloy can have a base composition of: R—Fe—B, R—Co—B, and R—(Co,Fe)—B wherein R is at least one of the rare earth metals, such as Nd—Fe—B; $RCo_5$, $R(Fe,Co)_5$, and $RFe_5$, such as $SmCo_5$; $R_2Co_{17}$, $R_2(Fe,Co)_{17}$, and $R_2Fe_{17}$, such as $Sm_2Co_{17}$; mischmetal-Co, mischmetal-Fe and mischmetal-(Co,Fe); Y—Co, Y—Fe and Y—(Co,Fe); or other similar alloys known in the art. The R—Fe—B alloy compositions disclosed in U.S. Pat. Nos. 4,597,938 and 4,802,931, the texts of which are incorporated by reference herein, are particularly suitable for use in accordance with the present invention.

In one preferred embodiment, the rare earth-containing alloy comprises, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron. Preferably, the rare earth element is neodymium and/or praseodymium. However, $RM_5$ and $R_2M_{17}$ type rare earth alloys, wherein R is at least one rare earth element selected from the group defined above and M is at least one metal selected from the group consisting of Co, Fe, Ni, and Mn may be utilized. Additional elements Cu, Ti, Bi, V, Nb, Ta, Cr, Mo, W, Mn, Al, Sb, Ge, Sn, Zr and Hf, may also be utilized. $RCo_5$ and $R_2Co_{17}$ are preferred for this type. The alloys, as well as the powders and magnets produced therefrom in accordance with the present invention, may contain, in addition to the abovementioned base compositions, impurities which are entrained from the industrial process of production.

In one embodiment, the alloys are crushed in water to produce particles having a particle size of from about 0.05 microns to about 100 microns and, preferably, from 1 micron to 40 microns, although larger size particles, such as up to about 300 microns, can also be utilized. Advantageously, the particle size is from 2 to 20 microns. The time required for crushing is not critical and will, of course, depend upon the efficiency of the crushing apparatus. The crushing is performed in water to prevent oxidation of the crushed alloy material. Furthermore, water has a low coefficient of viscosity and, therefore, crushing in water is more effective and faster than crushing in organic liquids presently utilized in the art. Also, crushing in water provides a higher defect density of domain wall pinning sites in the individual alloy particles, thereby providing better magnetic properties for the magnets produced from the powder. Finally, the size and shape of the individual alloy particles is optimized for alignment of the powder in a magnetic field to produce magnets. The type of water utilized is not critical. For example, distilled, deionized or non-distilled water may be utilized, but distilled is preferred.

In the aforesaid embodiment, after crushing, the crushed alloy material is then dried at a temperature below the phase transformation temperature of the material. More particularly, the crushed alloy material is dried thoroughly at a temperature which is sufficiently low so that phase transformation of the alloy material is not induced. The term "phase transformation temperature" as used herein means the temperature at which the stoichiometry and crystal structure of the base rare earth-containing alloy changes to a different stoichiometry and crystal structure. For example, crushed alloy material having a base composition of Nd—Fe—B will undergo phase transformation at a temperature of approximately 580° C. Accordingly, the Nd—Fe—B crushed alloy material should be dried at a temperature below about 580° C. However, as can be appreciated by those skilled in the art, the particular phase transformation temperature necessary for the alloy material utilized will vary depending on the exact composition of the material and this temperature can be determined experimentally for each such composition.

Preferably, the wet crushed alloy material is first put in a centrifuge or other appropriate equipment for quickly removing most of the water from the material. The material can then be vacuum dried or dried with an inert gas, such as argon or helium. The crushed alloy material can be effectively dried by the flow or injection of the inert gas at a pressure below 760 torr. Nevertheless, regardless of the drying technique, the drying must be performed at a temperature below the aforementioned phase transformation temperature of the material.

Subsequently, the alloy material is treated with a passivating gas at a temperature from ambient temperature to a temperature below the phase transformation temperature of the material. If the wet material was dried in a vacuum box, then the material can be treated with the passivating gas by injecting the gas into the box. The term "passivating gas" as used herein means a gas suitable for passivation of the surface of the material or powder particles so as to produce a thin layer on the surface of the particles in order to protect it from corrosion and/or oxidation. The passivating gas can be nitrogen, carbon dioxide or a combination of nitrogen and carbon dioxide. The temperature at which the powder particles are treated is critical and must be below the phase transformation temperature of the material. For example, the maximum temperature for treatment must be below about 580° C. when a Nd—Fe—B composition is used for the material. Generally, the higher the temperature, the less the time required for treatment with the passivating gas, and the smaller the particle size of the material, the lower the temperature and the shorter the time required for treatment. Preferably, alloy material of the Nd—Fe—B type is treated with the passivating gas from about one second to about 60 minutes at a temperature from about 20° C. to about 580° C. and, advantageously, at a temperature of about 175° C. to 225° C.

In another embodiment of the present invention, the powder is produced by placing arm ingot or piece of the rare earth-containing alloy in a crushing apparatus, such as an attritor or ball mill, and then purging the apparatus with a passivating gas to displace the air in the apparatus. The alloy is crushed in the passivating gas to a particle size of from about 0.05 microns to about 100 microns and, preferably, from 1 micron to 40 microns, although larger size particles, such as up to about 300 microns, can also be utilized. The time required for crushing is not critical and will, of course, depend upon the efficiency of the crushing apparatus. Furthermore, the crushing apparatus may be set-up to provide a continuous operation for crushing the alloy in a passivating gas. However, the temperature at which the alloy material is crushed in passivating gas is critical and must be below the phase transformation temperature of the material as defined above. Additionally, the passivating gas pressure and the amount of time the alloy material is crushed in the passivating gas must be sufficient to obtain the nitrogen or carbon surface concentration in the resultant powder and magnet as noted below.

When nitrogen is used as the passivating gas in accordance with the present invention, the resultant powder has a nitrogen surface concentration of from about 0.4 to about 26.8 atomic percent and, preferably, 0.4 to 10.8 atomic percent. Furthermore, when carbon dioxide is used as the passivating gas, the resultant powder has a carbon surface concentration of from about 0.02 to about 15 atomic percent and, preferably, 0.5 to 6.5 atomic percent. When a combination of nitrogen and carbon dioxide is utilized,the resultant powder can have a nitrogen surface concentration and carbon surface concentration within the above-stated ranges.

The term "surface concentration" as used herein means the concentration of a particular element in the region extending from the surface to a depth of 25% of the distance between the center of the particle and surface. For example, the surface concentration for a particle having a size of 5 microns will be the region extending from the surface to a depth of 0.625 microns. Preferably, the region extends from the surface to a depth of 10% of the distance between the center of the particle and surface. This surface concentration can be measured by Auger electron spectroscopy (AES), as can be appreciated by those skilled in the art. AES is a surface-sensitive analytical technique involving precise measurements of the number of emitted secondary electrons as a function of kinetic energy. More particularly, there is a functional dependence of the electron escape depth on the kinetic energy of the electrons in various elements. In the energy range of interest, the escape depth varies in the 2 to 10 monolayers regime. The spectral information contained in the Auger spectra are thus to a greater extent representative of the top 0.5 to 3 nm of the surface. See Metals Handbook®, Ninth Edition, Volume 10, Materials Characterization, American Society for Metals, pages 550–554(1986), which is incorporated by reference herein.

The alloy material is also heat treated at a temperature from about 300° C. to about 1100° C. for a sufficient time to achieve an increase in the intrinsic coercivity of the material at ambient temperature without sintering the material to substantially full density. The alloy material can be heat treated before being processed to form powder particles having the appropriate size and before being treated with a passivating gas. The material can also be heat treated after being processed to form appropriately sized powder particles but before being treated with a passivating gas. Additionally, the material can be heat treated after being processed to form appropriately sized powder particles and after being treated with a passivating gas.

In a preferred embodiment, the present invention further provides for an unique non-pyrophoric, corrosion resistant, anisotropic rare earth-containing powder comprising, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and further having a nitrogen surface concentration of from about 0.4 to about 26.8 atomic percent and a coercivity of at least 1000 Oersteds. Preferably, the rare earth element of the alloy powder is neodymium and/or praseodymium and the nitrogen surface concentration is from 0.4 to 10.8 atomic percent. In another preferred embodiment, the present invention provides for an unique non-pyrophoric, corrosion resistant, anisotropic rare earth-containing powder comprising, in atomic percent of the overall composition, from 12% to 24% of at least one rare earth element, selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and further having a carbon surface concentration of from about 0.02 to about 15 atomic percent and a coercivity of at least 1000 Oersteds. Preferably, the rare earth element is neodymium and/or praseodymium and the carbon surface concentration is from 0.5 to 6.5 atomic percent. Advantageously, each powder particle is either a single crystal or polycrystal with at least one axis of easy magnetization. The above-mentioned rare earth-containing powders are not only non-pyrophoric, but also resistant to oxidation and are capable of being aligned by a magnetic field to produce anisotropic polymer bonded permanent magnets having stable magnetic properties.

The present invention further encompasses a process for producing a polymer bonded, corrosion resistant, anisotropic permanent magnet. In one embodiment, this process comprises:

a) crushing a rare earth-containing alloy to form particles having a particle size of from about 0.05 microns to about 100 microns, said alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) treating the alloy particles with a passivating gas comprised of nitrogen, carbon dioxide or a combination of nitrogen and carbon dioxide at a temperature below the phase transformation temperature of the alloy;

c) heat treating the alloy particles at a temperature from about 300° C. to about 1100° C.; and d) aligning the alloy particles in a magnetic field and bonding the particles with a polymeric bonding agent.

The crushing, passivating and heat treating steps (steps a through c) are the same as disclosed above for producing powder.

In a further embodiment, the process for producing a polymer bonded, corrosion resistant, anisotropic permanent magnet in accordance with the present invention comprises:

a) crushing a rare earth-containing alloy to form particles having a particle size of from about 0.05 microns to about 100 microns, the rare earth-containing alloy comprising, in atomic percent of the overall composition, of from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) heat treating the alloy particles at a temperature from about 300° C. to about 1100° C.;

c) treating the alloy particles with a passivating gas comprised of nitrogen, carbon dioxide or a combination of nitrogen and carbon dioxide at a temperature below the phase transformation temperature of the alloy; and d) aligning the alloy particles in a magnetic field and bonding the particles with a polymeric bonding agent.

The crushing, heat treating and passivation steps (steps a through c) are the same as disclosed above for producing powder.

In another embodiment, the process for producing a polymer bonded, corrosion resistant, anisotropic permanent magnet in accordance with the present invention comprises:

a) heat treating a rare earth-containing alloy at a temperature from about 300° C. to about 1100° C. said alloy comprising, in atomic percent of the overall composition, of from about 12% to about 24% of at least one rare earth element, selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and the balance iron;

b) crushing the alloy to form particles having a particle size of from about 0.05 microns to about 100 microns;

c) treating the alloy particles with a passivating gas comprised of nitrogen, carbon dioxide or a combination of nitrogen and carbon dioxide at a temperature below the phase transformation temperature of the material; and d) aligning the alloy particles in a magnetic field and bonding the particles with a polymeric bonding agent.

The heat treating, crushing and passivation steps (steps a through c) are the same as disclosed above for producing powder.

The alloy particles are aligned in a magnetic field to produce anisotropic permanent magnets. The term "anisotropic" as used herein means the material has magnetic anisotropy. More particularly, the material exhibits at least one direction of easy magnetization. Preferably, a magnetic field of about 7 to 15 kOe is applied in order to align the particles.

The polymeric bonding agent can be comprised of any appropriate inorganic or organic polymers, or combinations thereof, known in the art. The particles are bound in a desired shape after alignment in a magnetic field by being mixed with the polymeric bonding agent so that the particles are interspersed within the bonding agent. The mixture of particles and bonding agent can be compacted under pressure and cured to produce the polymer bonded anisotropic permanent magnet. If necessary, the mixture may be heated to a temperature sufficient to cure the polymer, such as when an epoxy resin bonding agent is utilized.

When nitrogen is used as the passivating gas to treat the alloy material, the particles of the resultant permanent magnet will have a nitrogen surface concentration of from about 0.4 to about 26.8 atomic percent and, preferably, 0.4 to 10.8 atomic percent. When carbon dioxide is used as the passivating gas, the particles of the resultant permanent magnet will have a carbon surface concentration of from about 0.02 to about 15 atomic percent and, preferably, from 0.5 to 6.5 atomic percent. Of course, if a combination of nitrogen and carbon dioxide is used, the surface concentrations of the respective elements will be within the above-stated ranges.

Another preferred embodiment of the present invention includes a polymer bonded, corrosion resistant, anisotropic permanent magnet of the type comprising a polymeric bonding agent interspersed with single crystal or polycrystalline particles comprised of, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, and having a nitrogen surface concentration of from about 0.4 to about 26.8 atomic percent and, preferably, from 0.4 to 10.8 atomic percent. The magnet has a coercivity of at least 1,000 Oersteds. The preferred rare earth element is neodymium and/or praseodymium. A further preferred embodiment is a polymer bonded, corrosion resistant, anisotropic permanent magnet of the type comprising a polymeric bonding agent interspersed with single crystal or polycrystalline particles comprised of, in atomic percent of the overall composition, from about 12% to about 24% of at least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, from about 2% to about 28% boron and at least 52% iron, wherein the improvement comprises a carbon surface concentration of from about 0.02 to about 15 atomic percent and, preferably, 0.5 to 6.5 atomic percent. The magnet has a coercivity of at least 1,000 Oersteds. The preferred rare earth element is also neodymium and/or praseodymium.

The polymer bonded permanent magnets in accordance with the present invention are non-pyrophoric, corrosion resistant, anisotropic and magnetically stable. Furthermore, these magnets are readily machinable. In order to more clearly illustrate this invention, the examples set forth below are presented. The following examples are included as being illustrations of the invention and should not be construed as limiting the scope thereof.

EXAMPLES

Alloys were made by induction melting a mixture of substantially pure commercially available forms of elements to produce the following composition in weight percent: Nd—35.2%, B—1.2%, Dy—0.2%, Pr—0.4%, Mn—0.1%, Al—0.1% and Fe— balance. Powders were then prepared from this base composition in accordance with the present invention. The alloys were crushed in distilled water, dried in vacuum and treated with a passivating gas.

FIGS. 1–11 illustrate the distribution of particle size and shape of powder for various weight ratios between powder and milling balls ($P_a/P_b$) and grinding times. The powder samples were oriented in a magnetic field and measurements were made on a plane perpendicular to the magnetic field. FIGS. 1–11 show that the particle size and shape of powder produced in accordance with the present invention were optimized for compacting of the powder in a magnetic field to produce magnets since the number of desired rectangular shaped particles was maximized.

Figure 12:
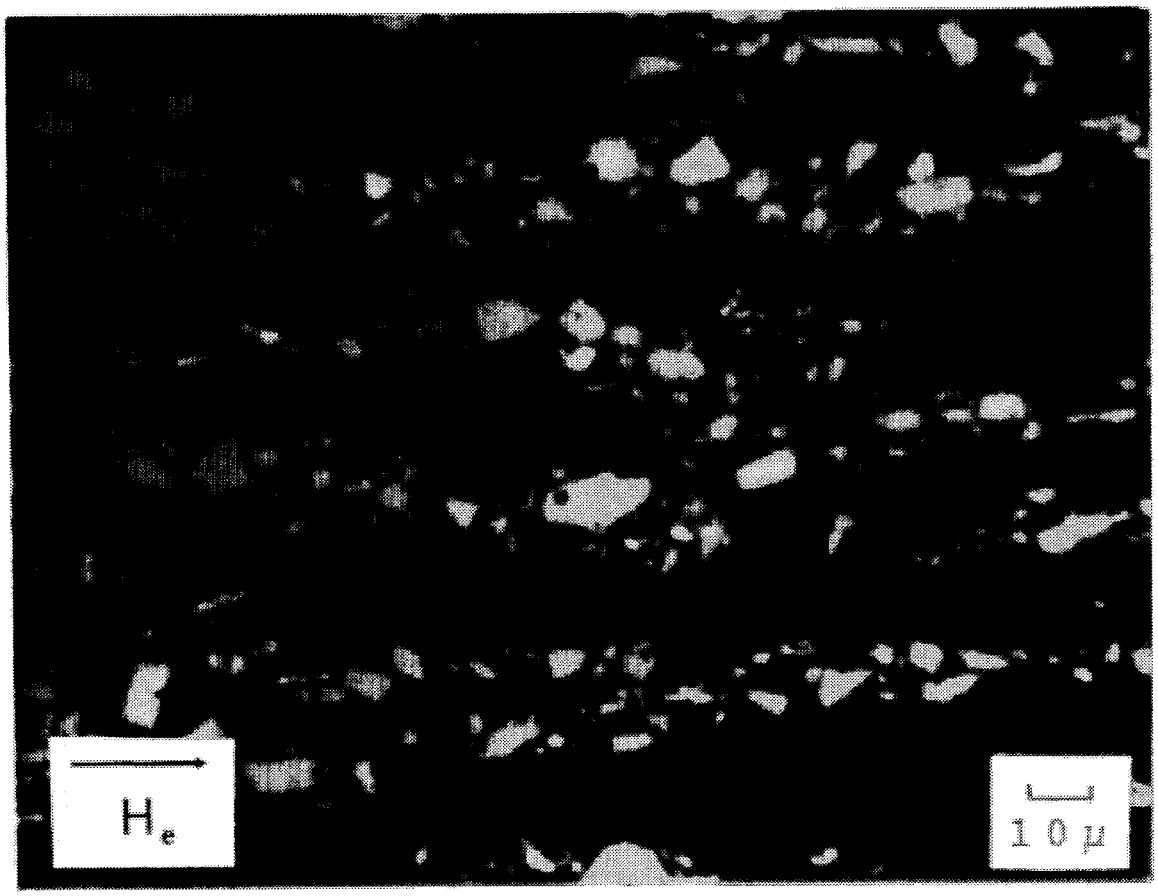
FIG. 12 is a photomicrograph at 650× magnification of Nd—Fe—B powder produced in accordance with the present invention and oriented in a magnetic field.
Figure 13:
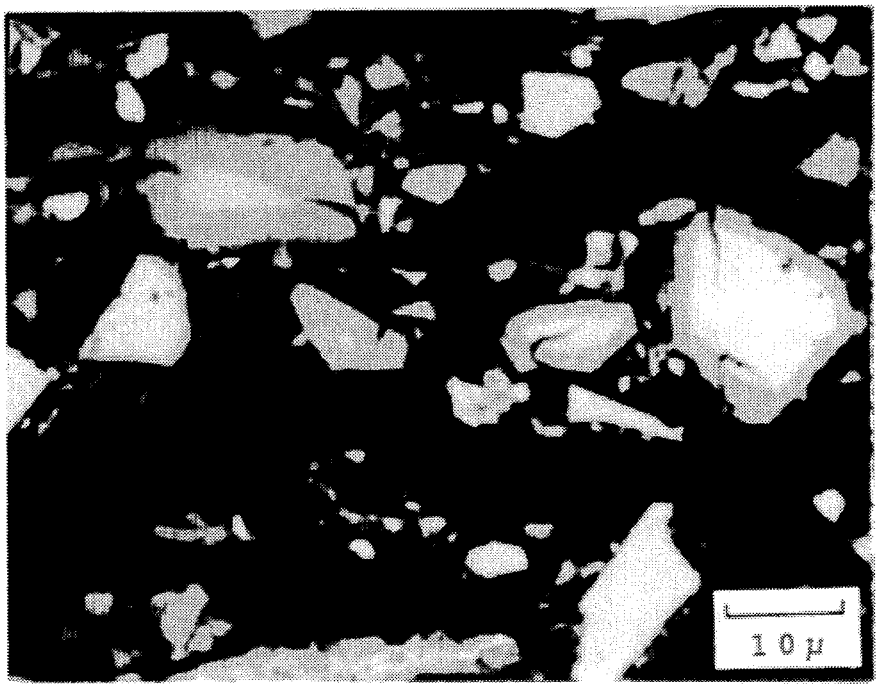
FIG. 13 is a photomicrograph at 1600× magnification of Nd—Fe—B powder produced in accordance with the present invention.
Figure 14:
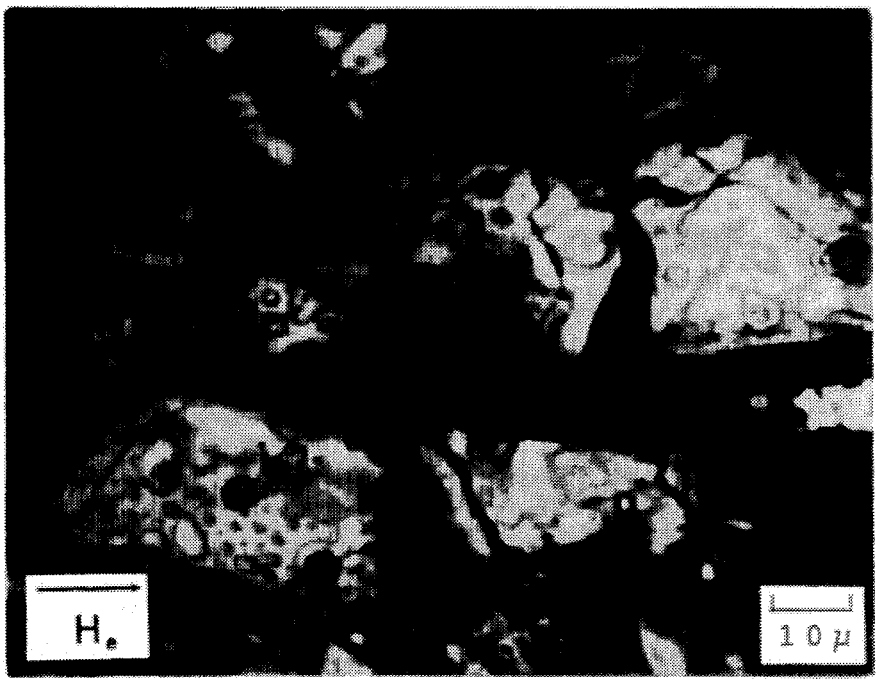
FIG. 14 is a photomicrograph at 1100× magnification of Nd—Fe—B powder produced by conventional powder metallurgy technique and oriented in a magnetic field.

FIG. 12 illustrates a distribution of particle size and shape of Nd—Fe—B powder produced in accordance with the present invention and oriented in a magnetic field ($H_e$) as shown in the figure. FIG. 13 illustrates Nd—Fe—B powder produced in accordance with the present invention wherein the nitrogen containing surface layer is visible. FIG. 14 illustrates Nd—Fe—B powder produced by conventional powder metallurgy technique with the powder crushed in hexane and oriented in a magnetic field ($H_e$) as shown in the figure. Corrosion is evident in the conventional powder illustrated in FIG. 14.

Figure 15:
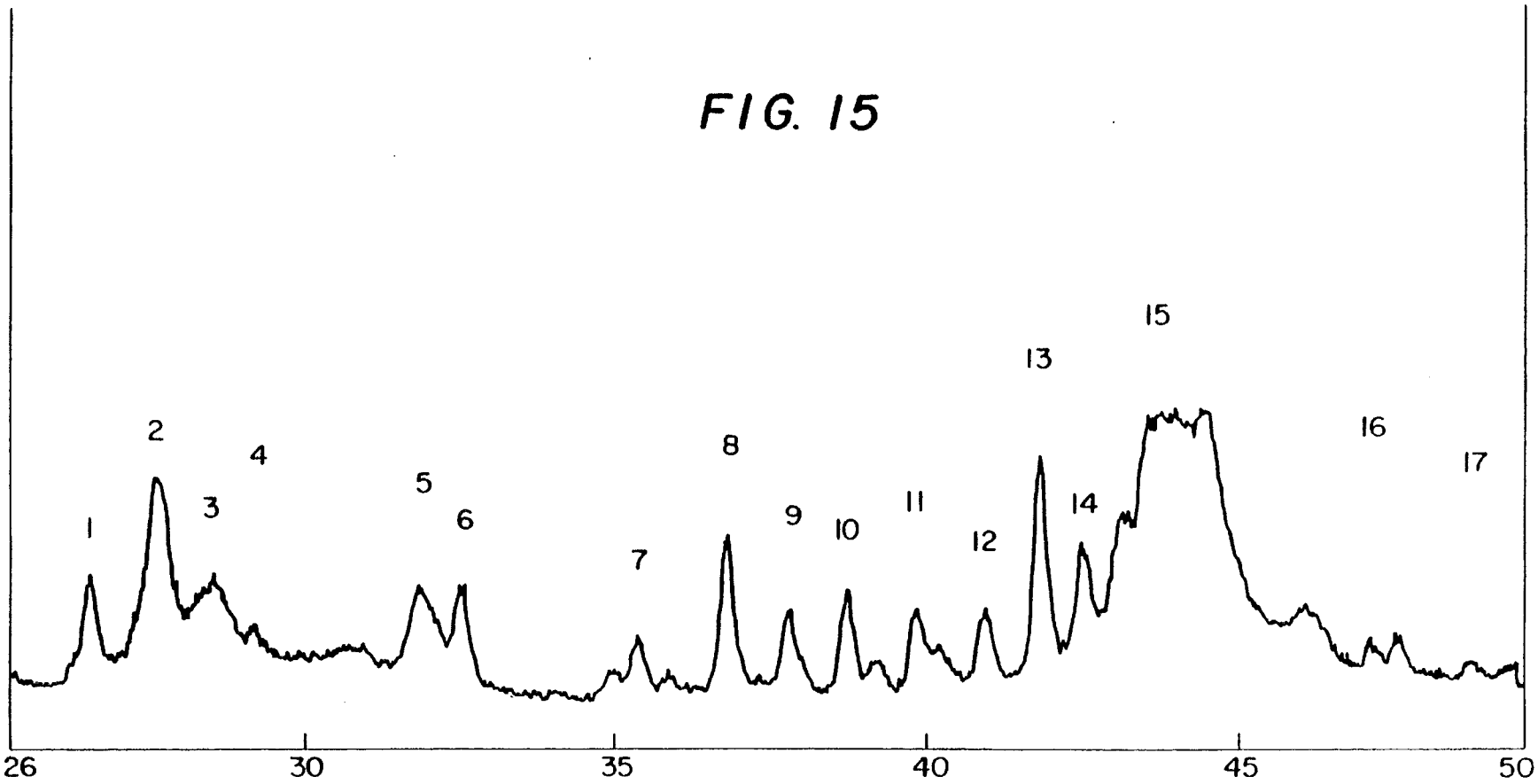
FIG. 15 is an X-ray diffraction pattern of Nd—Fe—B powder produced in accordance with the present invention.
Figure 16:
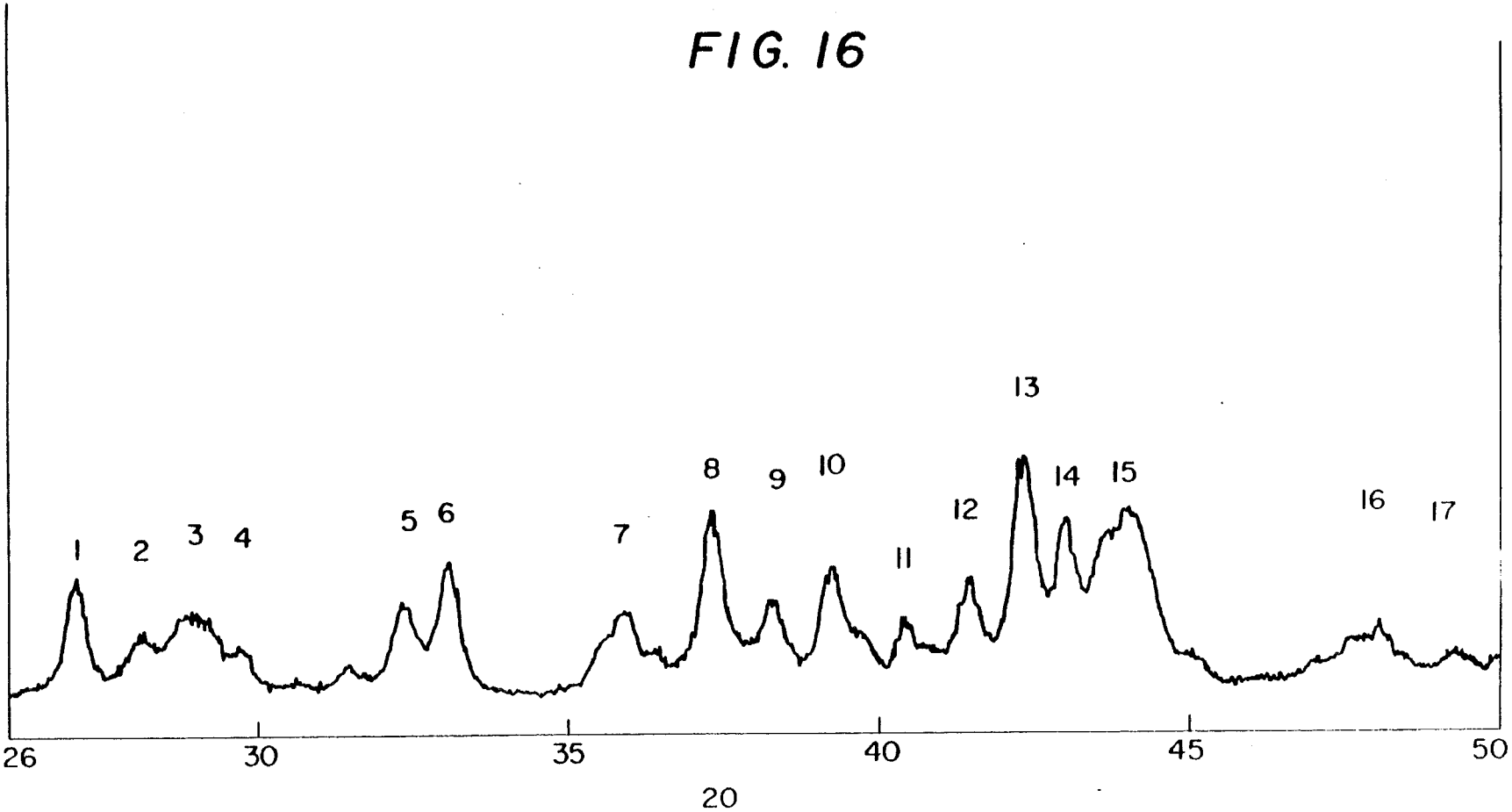
FIG. 16 is an X-ray diffraction pattern of Nd—Fe—B powder produced by conventional powder metallurgy technique.

FIG. 15 is an X-ray diffraction pattern of Nd—Fe—B powder produced in accordance with the present invention and FIG. 16 is an X-ray diffraction pattern of Nd—Fe—B powder produced by conventional powder metallurgy technique. Comparison of FIG. 15 and FIG. 16 illustrates the difference in peak widths which indicates a higher defect density of domain wall pinning sites in the individual particles of the present invention. Comparison of FIG. 15 and FIG. 16 also illustrates the difference in peak widths which indicates a higher density of defects that nucleate domains in the individual particles of the conventional powder, which adversely affect magnetic properties.

Powders were prepared from the above-mentioned base composition in accordance with the present invention and the experimental parameters, including: the weight ratio between powder and milling balls ($P_a/P_b$), the length of time (T) the alloys were crushed in minutes, the typical particle size range of the powder after crushing ($D_p$) in microns, and the temperature at which the powder was treated with the passivating gas ($T_p$) in degrees centigrade, are given below in Table I. Nitrogen was used as the passivating gas for Samples 1, 4, 7 and 10. Carbon dioxide was used as the passivating gas for Samples 2, 5, 8, and 11. A combination of nitrogen and carbon dioxide was used as the passivating gas for Samples 3, 6, 9 and 12. Sample 13 is a prior art sample made by conventional methods for comparison. FIG. 14 is a photomicrograph of Sample 13 and FIG. 16 is an X-ray diffraction pattern of Sample 13.

TABLE I

| Sample Number | $P_a/P_b$ | T (min) | $D_p$ (μm) | $T_p$ (°C.) | Surface Concentration (Atomic %) N | C |
|---|---|---|---|---|---|---|
| 1 | 1:24 | 30 | 0.5–5 | 90 | 1.0 | — |
| 2 | " | " | " | 115 | — | 1.0 |
| 3 | " | " | " | 125 | 1.0 | 1.0 |
| 4 | " | " | " | 155 | 5.0 | — |
| 5 | " | " | " | 150 | — | 5.0 |
| 6 | " | " | " | 175 | 5.0 | 5.0 |
| 7 | " | " | " | 175 | 7.6 | — |
| 8 | " | " | " | 195 | — | 5.1 |
| 9 | " | " | " | 195 | 7.6 | 5.1 |
| 10 | " | " | " | 300 | 22.5 | — |
| 11 | " | " | " | 340 | — | 6.5 |
| 12 | " | " | " | 340 | 10.8 | 6.5 |
| 13 | 1:9 | 45 | 7–15 | — | — | — |

Additional powder samples were made in accordance with the present invention. Fifty mesh cast alloy powder having the following reported base composition in weight percent was utilized: Nd—32.1%, Dy—1.8%, Pr—0.41%, O—0.21%, B—1.2% and Fe— balance. Sample Nos. P1, P2 and P3 were crushed in water to an average particle size of 12 microns, passivated in $CO_2$ at 175° C., and then heat treated at the temperatures and for the times reported below in Table II. Sample Nos. P4 and P5 were first heat treated as reported below, then crushed in water to an average particle size of 12 microns and passivated in $CO_2$ at 175° C. All heat treatment steps utilized furnace cooling except for the last heat treatment steps for Sample Nos. P1, P4 and P5, which were air cooled. The observed remanent magnetization (4πM) and intrinsic coercive force (Hci) of the powder samples are also reported in Table II below.

TABLE II

| Sample No. | Heat Treatment (°C./minutes) Step 1 | Step 2 | Step 3 | Step 4 | 4 πM (kG) | Hci (kOe) |
|---|---|---|---|---|---|---|
| P1 | 825° C./120 | 610° C./60 | 500° C./120 | 600° C./1 | 11.48 | 5.86 |
| P2 | 750° C./120 | 610° C./60 | 500° C./120 | — | 11.34 | 6.26 |
| P3 | 850° C./120 | 610° C./60 | 500° C./120 | — | 11.98 | 6.40 |
| P4 | 850° C./120 | 610° C./60 | 500° C./120 | 125° C./1 | 10.85 | 6.98 |

TABLE II-continued

| Sample No. | Heat Treatment (°C./minutes) Step 1 | Step 2 | Step 3 | Step 4 | 4 πM (kG) | Hci (kOe) |
|---|---|---|---|---|---|---|
| P5 | 800° C./120 | 610° C./60 | 500° C./120 | 300° C./1 | 11.37 | 7.28 |

Furthermore, anisotropic bonded magnets were made from several different types of powders, which were processed in accordance with the present invention. The powders were prepared from raw materials having the following reported compositions:

#1 — 50 mesh cast alloy powder having the composition (wt. %): Nd—31.5%, Dy—3.72%, Pr—0.52%, Al—0.4%, B—1.12%, O—0.183% and Fe—balance.

#2— 50 mesh cast alloy powder having the composition (wt %): Nd—30.97%, Dy—3.71%, Pr—0.28%, B—1.1% and Fe—balance.

#3— Atomized powder having the composition (wt %): Nd—24.65%, Dy—8.42%, Pr—0.30%, Al —0.08%, B—1.12%, O—0.09% and Fe—balance.

#4— Atomized powder having the composition (wt. %): Nd—31.0%, Dy—3.5%, Pr—0.42%, Al—0.4%, B—1.12%, O—0.07% and Fe—balance.

#5— Melt-spun MQP-A MAGNEQUENCH Nd—Fe—B powder produced by Delco Remy, Division of General Motors Corporation—composition not available. (MAGNEQUENCH is a registered trademark of General Motors Corporation).

All samples were produced from material that was passivated by heating the material to 175° C., and then placing the material in a $CO_2$ atmosphere which was maintained during furnace cooling. Samples B1–B10 were passivated first and then heat treated, and Samples B11–B18 were heat treated first and then passivated. All heat treatment steps utilized furnace cooling except for the last heat treatment step for Sample No. B11, which was air cooled. Magnetic properties of the resulting bonded magnets were measured. The processing parameters and observed results are reported in Table III below. It is believed that the poor coercivity results observed for Sample B3 may have been due to poor quality raw material which may have been oxidized. Furthermore, it is believed that the poor coercivity results observed for Sample B11 may have been due to the parameters utilized in Step 1 of the heat treatment for this Sample.

TABLE III

| Sample No. | Powder Material | Maximum Particle Size (microns) | Compaction Pressure (ton/cm²)** | % of Bonding Material | Heat Treatment (°C./minutes) Step 1 | Step 2 | Step 3 | Step 4 | Density (g/cm³) | Br (kG) | Hci (kOe) | BHmax (MGOe) |
|---|---|---|---|---|---|---|---|---|---|---|---|---|
| B1 | #1 | 44 | 8 | 2% L | 1080° C./10 | 900° C./60 | 600° C./60 | 500° C./120 | 5.43 | 2.57 | 1.36 | 0.62 |
| B2 | #1 | 44 | 8 | 2% L | 900° C./60 | 600° C./60 | 500° C./120 | — | 5.76 | 4.37 | 1.40 | 1.42 |
| B3 | #2 | 44 | 8 | 2% L | 1080° C./10 | 900° C./60 | 600° C./60 | 500° C./120 | 5.29 | 2.61 | 0.89 | 0.48 |
| B4 | #3 | 4* | 8 | 2% P | 900° C./5 | 500° C./30 | — | — | 5.44 | 3.05 | 2.86 | 1.23 |
| B5 | #3 | 44 | 8 | 2% L | 1080° C./10 | 900° C./60 | 600° C./60 | 500° C./120 | 5.83 | 3.75 | 3.79 | 2.12 |
| B6 | #4 | 4* | 8 | 2% L | 900° C./60 | 600° C./60 | 500° C./120 | — | 6.08 | 4.14 | 4.10 | 2.16 |
| B7 | #4 | 44 | 4 | 12% P | 900° C./60 | 610° C./60 | 510° C./120 | — | 4.80 | 2.55 | 2.03 | 0.73 |
| B8 | #4 | 44 | 6 | 3% P | 900° C./10 | 600° C./60 | 500° C./120 | — | 5.15 | 5.52 | 4.68 | 4.80 |
| B9 | #4 | 44 | 7 | 3% P | 900° C./60 | 610° C./60 | 500° C./60 | 510° C./60 | 5.66 | 2.74 | 1.16 | 0.56 |
| B10 | #4 | 44 | 7 | 2% P | 900° C./60 | 610° C./60 | 500° C./60 | — | 5.69 | 3.10 | 1.45 | 0.79 |
| B11 | #4 | 75 | 8 | 7% L | 1100° C./180 | 900° C./60 | 600° C./60 | 500° C./120 | 4.73 | 2.57 | 0.88 | 0.45 |
| B12 | #5 | 44 | 6 | 3% P | 900° C./60 | 610° C./60 | 510° C./120 | — | 5.03 | 4.38 | 3.74 | 2.60 |
| B13 | #5 | 44 | 6 | 3% L | 900° C./60 | 610° C./60 | 510° C./120 | — | 5.51 | 4.77 | 12.95 | 4.53 |
| B14 | #5 | 44 | 6 | 5% L | 900° C./60 | 610° C./60 | 510° C./120 | — | 5.26 | 5.23 | 13.07 | 5.30 |
| B15 | #5 | 44 | 6 | 8% L | 900° C./60 | 610° C./60 | 510° C./120 | — | 4.28 | 4.79 | 13.21 | 4.56 |
| B16 | #5 | 44 | 4 | 3% L | 900° C./60 | 610° C./60 | 510° C./120 | — | 5.16 | 5.23 | 12.81 | 5.26 |
| B17 | #5 | 44 | 6 | 3% L | 900° C./60 | 610° C./60 | 510° C./120 | — | 5.63 | 5.33 | 13.11 | 5.57 |
| B18 | #5 | 44 | 8 | 3% L | 900° C./60 | 610° C./60 | 510° C./120 | — | 5.73 | 5.33 | 13.06 | 5.60 |

Note: L - liquid epoxy
P - powder epoxy
*Average particle size instead of maximum particle size
**Compacted in magnetic field of 15 kOe

What is claimed is:

1. A polymer bonded, corrosion resistant, anisotropic permanent magnet comprising a polymeric bonding agent interspersed with single crystal or polycrystalline particles, said particles being comprised of $R_2Fe_{17}$ wherein R is a least one rare earth element selected from the group consisting of neodymium, praseodymium, lanthanum, cerium, terbium, dysprosium, holmium, erbium, europium, samarium, gadolinium, promethium, thulium, ytterbium, lutetium, yttrium, and scandium, said particles having a nitrogen surface concentration of from about 0.4 to about 26.8 atomic percent and a carbon surface concentration of from about 0.02 to about 15 atomic percent, said particles further having a higher concentration of nitrogen and carbon in the surface region than in the center of the particles, said magnet having a coercivity of at least 1,000 Oersteds.

2. The permanent magnet of claim 1 wherein the rare earth element is samarium.

3. The permanent magnet of claim 1 wherein the nitrogen surface concentration is from 0.4 to less than 10.0 atomic percent.

4. The permanent magnet of claim 1 wherein the carbon surface concentration is from 0.5 to 6.5 atomic percent.

5. The permanent magnet of claim 1 wherein the nitrogen surface concentration is from 0.4 to less than 10.0 atomic percent and the carbon surface concentration is from 0.5 to 6.5 atomic percent.

* * * * *